United States Patent [19]

Hickin

[11] Patent Number: 4,726,597

[45] Date of Patent: Feb. 23, 1988

[54] COMBINATION GOLF CART AND GOLF BAG ASSEMBLY

[76] Inventor: Raymond Hickin, 9032 Darwin St., Chilliwack, British Columbia, Canada, V2P 6W8

[21] Appl. No.: 7,467

[22] Filed: Jan. 28, 1987

[51] Int. Cl.[4] ..... B62B 1/12

[52] U.S. Cl. ..... 280/47.17; 280/DIG. 6; 224/42.03 R

[58] Field of Search ..... 280/30, 47.13 R, 47.17, 280/47.18, 47.37 R, DIG. 6, 652, DIG. 5; 211/70.2, 100; 224/42.03 A, 42.03 R, 42.20, 42.21

[56] References Cited

U.S. PATENT DOCUMENTS

| | | | |
|---|---|---|---|
| 1,231,030 | 6/1917 | Kelly | 280/DIG. 6 |
| 2,590,178 | 3/1952 | Jamison | 280/DIG. 6 |
| 2,926,713 | 3/1960 | Vaughan | 211/70.2 |
| 3,941,398 | 3/1976 | Nelson | 280/DIG. 6 |
| 4,006,852 | 2/1977 | Pilsner et al. | 224/42.03 A |
| 4,241,858 | 12/1980 | Lawroski | 224/42.03 A |
| 4,337,882 | 7/1982 | Hampton | 211/70.2 |

*Primary Examiner*—John J. Love
*Assistant Examiner*—Richard Camby
*Attorney, Agent, or Firm*—Francis X. LoJacono

[57] ABSTRACT

A combination golf cart and golf bag assembly formed having a rigid tubular housing defining a capsule with a removable cover, the housing being provided with both upper and lower closed ends, wherein a plurality of elongated tubes are mounted in the upper end for receiving the shafts of golf clubs, a cup member being centrally positioned in the upper closed end for storing equipment, and the capsule being mountable to the outside structure of a vehicle by means of a first and a second structure bracket, there being wheels mounted to the lower end of the capsule and a removable handle mounted at the upper end of the capsule to define a cart in conjunction with a golf bag.

5 Claims, 7 Drawing Figures

COMBINATION GOLF CART AND GOLF BAG ASSEMBLY

BACKGROUND OF THE INVENTION

1. Field of the Invention

This invention relates to a combination golf cart and golf bag assembly, and more particularly to a golf bag defined by a rigid capsule-like container adapted not only to contain and carry golf clubs and related accessories but also to define a transportation means that can be readily attached to various types of recreational vehicles and small automobiles. Heretofore, this was not possible.

2. Description of the Prior Art

It is well known in the art that various problems and difficulties are being encountered in providing a suitably structured, all-weather, wheeled golf-cart assembly that can be readily mounted on the outside surface of a recreational vehicle, on a car-top carrier, on a bicycle-type carrier, and which can also be used as a self-contained shipping container to be sent by bus or airline.

Various types of bags and carts are used for storing and transporting golf clubs, etc. However, these bags and carts, as good as they are, still have certain features that restrict or limit their use as shipping containers. That is, conventional golf bags and cart assemblies create a storage problem for the avid golfer while traveling by recreational vehicle or small automobile, since the confines of these types of vehicles offer very limited space, usually for more essential items. Hence, there is a need for an especially designed assembly as hereinafter presented.

Various types and arrangements of golf carts, bags, etc., are shown in the following U.S. patents.

U.S. Pat. No. 4,522,299 discloses a golf-club bag having an integral outer shell, a top panel closing the upper end of the shell, with shaft apertures therein, a core within the shell, stops at the lower end of the core, guide chanels in the core forming handle recesses, a handle on the exterior of the shell and a releasable closure for the upper end of the shell.

U.S. Pat. No. 4,420,024 comprises a golf-club bag that is formed by a plurality of elongated receptacles attached together in a row and parallel to one another to lie generally flat on a support surface. The receptacles are made of a resilient material which will allow folding the receptacles over one another into a bundle as well as laying the receptacles out generally flat.

U.S. Pat. No. 4,442,947 relates to a golf-club bag but more particularly to a clamp-on cover for the top of a golf bag which provides a vertical hemi-cylindrical shield extending from the back of the bag in an upward direction, with a helmet shaped portion pivoted at the brim to a rear portion of the hemi-cylindrical shield. The helmet-shaped portion is used when opened by means of a hinge.

U.S. Pat. No. 4,550,930 discloses a golf-caddy assembly comprising a two-wheeled cart incorporating an upstanding frame which provides and includes a lower horizontal platform projecting rearwardly of the frame for supporting a golf bag and an upper forwardly projecting retractable handle assembly.

A carrier accessory for vans is disclosed in U.S. Pat. No. 4,241,858. This device is particularly designed as a carrier for sporting goods, tools, household supplies and the like, utilizing a bracket adaptable to vans of various types and supportable on existing hinge brackets of the rear doors of a van with supplemental support from a frame or bumper member.

In U.S. Pat. No. 4,017,091 there is disclosed a convertible golf cart which can be wheeled over a golf course carrying golf equipment, and can be readily disassembled for transportation and storage. Detachable wheels and a retracting-removable handle and support strut serve to convert the golf cart from its operating condition to a storage and transport condition.

U.S. Pat. No. 4,355,756 discloses a golf-bag holder for use with golf carts which includes a frame structure having a plurality of arms pivotally mounted thereto.

In U.S. Pat. No. 4,337,882 there is disclosed a golf-club cart carrier supportable on a trailer-hitch mounting bar, there being an upwardly sloping arm pivotally attached to the bar having at an outer end a vertical tubular socket adapted to mate with a tubular extension on the carrier.

BRIEF SUMMARY AND OBJECTS OF THE INVENTION

The present invention comprises a combination golf cart and bag. The bag is better defined as a rigid, tubular capsule adapted to receive and store a plurality of golf clubs along with various golf accessories such as balls, tees, gloves, etc. A rigid plastic cover or lid is also provided to protect the equipment stored therein. The bottom closed end of the tubular capsule is provided with attached wheels whereby the assembly is readily used as a typical golf cart. Moreover, the capsule includes attaching members whereby the golf-cart-and-bag assembly is capable of being removably mounted on the outside surface of, for example, a recreational vehicle, on a car-top carrier, on a bicycle-type carrier, etc.

Accordingly, it is an important object of the present invention to provide a golf bag and golf cart that can be combined as a single unit, so as to easily allow for safe storage and transporting of golf clubs and accessories.

It is another object of the invention to provide a golf bag that is defined as a rigid tubular capsule having a removable handle at one end thereof and wheels at the opposite closed end, so that it can be transported in the same manner as any golf cart.

It is still another object of the invention to provide various means for attaching the fully loaded golf cart/-bag assembly to the various types of vehicles mentioned without causing damage to the vehicle itself or the assembly, and particularly the golf equipment stored therein.

A further object of the present invention is to eliminate storage problems within most vehicles that many times prevent golfers from taking their golf clubs along on vacations and long trips.

A still further object of the invention is to provide a device of this type that can be readily shipped by many different types of transportation means, such as an airplane or bus.

Still another object of the invention is to provide a device of this character that is not affected by the outside elements.

It is a further object of the present invention to provide a combination golf cart and bag that is made from a rigid plastic that is relatively inexpensive to manufacture, and that is simple and rugged in construction.

Another object of the invention is to provide a device of this type that has few operating parts, and thus is easy to service and maintain.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described preferred embodiments of the invention.

DESCRIPTION OF THE DRAWINGS

Referring more particularly to the accompanying drawings, which are for illustrative purposes only, wherein like reference numerals refer to like parts therein.

DESCRIPTION OF THE PREFERRED EMBODIMENT

Figure 1:
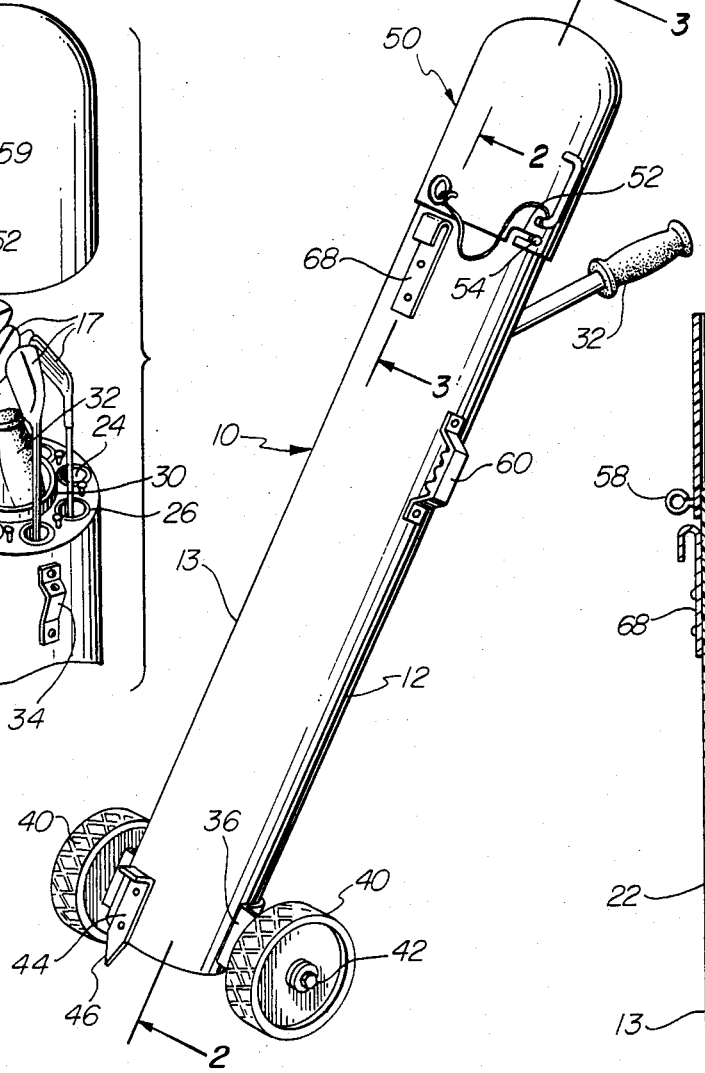
FIG. 1 is a perspective view of the golf-cart-and-bag assembly including the associated protective cover mounted thereon.

Referring more particularly to FIG. 1, there is shown the present invention which comprises the combination of a golf bag and a golf cart assembled into a single unit, generally indicated at 10, and is readily adapted for carrying golf clubs, golf balls, tees and other golfing accessories, taking the place of a separate golf bag and golf cart.

In order to provide such a combination, the present invention comprises a rigid outer tubular capsule 12 which in itself defines a golf bag. Capsule 12 is preferably formed as an extruded plastic tubular housing 13 having a closed bottom wall 14 (better illustrated in FIG. 2). Bottom wall 14 is secured to the base end of housing 13 by means of any suitable adhesive or plastic welding. However, it is also contemplated that the capsule unit 12 could also be formed from a suitable metal.

Figure 5:
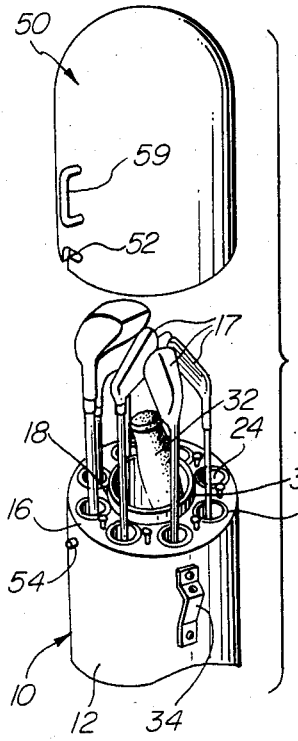
FIG. 5 is an exploded view, showing the cover separated from the capsule with golf clubs and various accessories stored therein.

The upper end is also closed off by a top cap or wall member 16 which is more clearly shown in FIG. 5. Again, top wall member 16 is secured to the open end of the tubular housing 13, so as to define a capsule having an elongated interior compartment 15.

Figure 2:
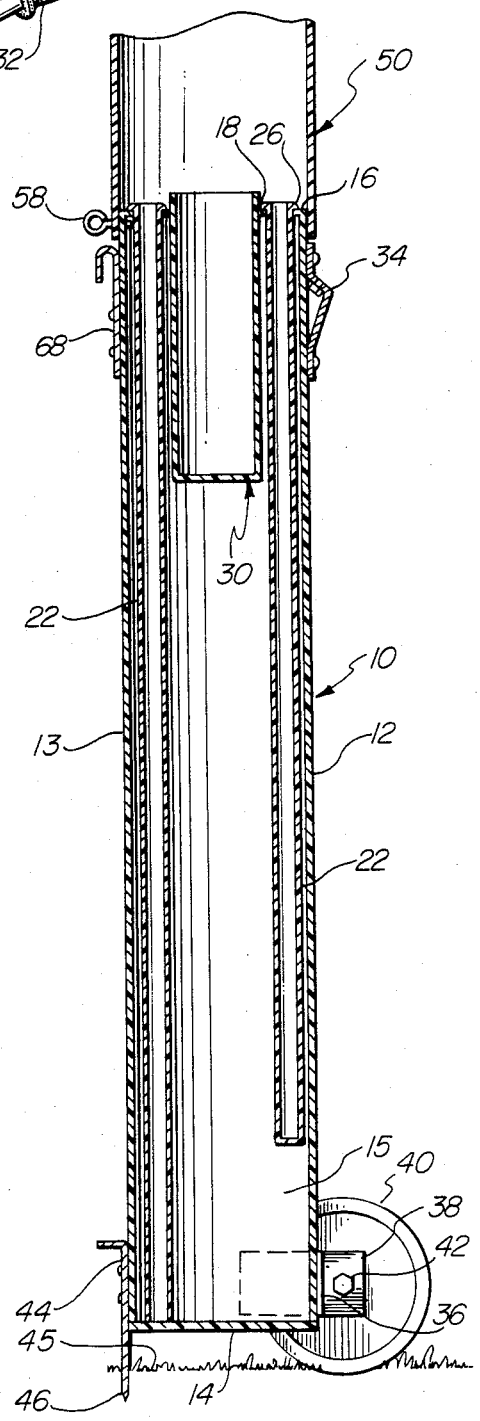
FIG. 2 is a cross-sectional view taken substantially along line 2—2 of FIG. 1, showing the capsule in an upright position and with its cover removed therefrom.
Figure 3:
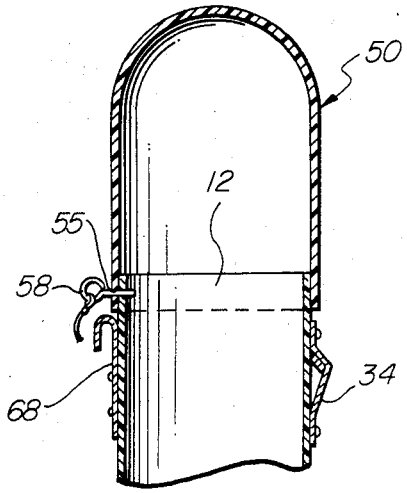
FIG. 3 is a cross-sectional view taken substantially along line 3—3 of FIG. 1, showing the position of the locking pin between the cover and the open end of the capsule.

In order for the capsule to store and support golf clubs 17 and other related golf equipment, top wall member 16 is formed with a centrally positioned, enlarged opening 18 and a plurality of small holes 20 which are arranged sequentially about wall member 16 adjacent the tubular housing 13, as seen in FIGS. 2 and 5. The number of smaller holes 20 will depend on the circumference of housing 13. However, the diameter of the capsule must be of an appropriate size to allow it to be readily secured to the various types of vehicles. Hence, it is contemplated that eight holes, each being approximately one and a quarter ($1\frac{1}{4}$) inches in diameter, would be the optimum number to accommmodate an elongated plastic tube 22. Due to the different types and sizes of golf clubs 17, the distances between holes must be such that proper spacing between each tube 22 can be achieved.

Each tube 22 is formed with an upper open end 24 provided with an annular rolled edge 26 whereby the tube is suspended within compartment 15. It should be noted, however, that tubes 22 can be formed in different lengths to accommodate the different lengths of clubs. Preferably, the tubes 22 are fixedly supported by top wall 16 so as to establish an even more rigid unit. However, this is not necessarily required or desired since with some models it might be that the tubes should be interchanged for the different sizes of clubs.

Referring again to the central opening 18, there is secured therein an elongated cup 30 which provides a means to store golf balls, gloves and related equipment, as well as the removable handle 32 which is shown in FIGS. 1 and 5. FIG. 1 illustrates the handle 32 as being attached to housing 13, whereas FIG. 5 illustrates handle 32 as being stored in cup 30.

Accordingly, in order to provide a means for removably attaching handle 32 to housing 13, there is fixedly secured to the upper end of housing 13 an attaching member 34 which is suitably provided with threads to allow handle 32 to be mounted thereon. However, it can be understood that various other handle attaching means could also be employed.

In order to establish the cart arrangement for capsule 12, a rigid support strap 36 is secured adjacent the lower end of the capsule. Strap 36 is formed with oppositely positioned ear members 38 that extend forwardly from housing 13 to allow wheels 40 to be rotatably mounted to each ear member by pin member 42, as seen in FIG. 1. Hence, when handle 32 is attached to member 34, the golf cart/golf bag unit 10 becomes readily movable from place to place.

A spike member 44 is affixed to the lower end of housing 13 on the rearward side opposite wheel support bracket 36, as illustrated in FIG. 2. This provides a means to position capsule 12 in an upright position. Spike member 44 is formed with a pointed end 46 that extends below bottom wall 14 to allow the spike to pierce the ground or golf turf 45, thus securing unit 10 in a stable position.

Figure 7:
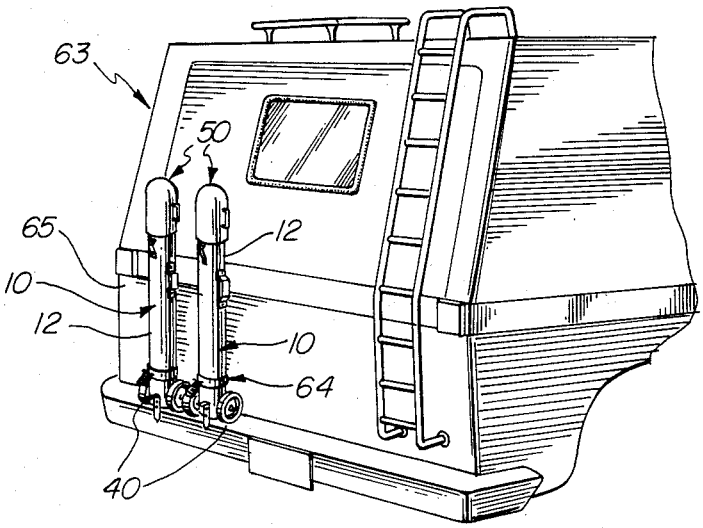
FIG. 7 is a pictorial view of a rear portion of a vehicle illustrating how one or more of the golf-cart-and-bag assemblies can be positioned and mounted to the outside surface of a vehicle.

When the golf cart/golf bag 10 is to be stored and/or shipped as illustrated in FIG. 7, there is mounted over the upper end of capsule 12 a rigidly formed cover means, generally indicated at 50. A suitable means for mounting cover 50 to capsule 13 is located therebetween. That is, a locking slot 52 is formed in cover 50 and is adapted to receive a locking pin 54 as the cover is rotated to a locked position. Both the cover 50 and the housing 13 are provided with holes 55 and 56, respectively, which become aligned when locking pin 54 is positioned in slot 52. Once holes 55 and 56 are aligned, a second pin 58 is inserted through both holes so as to prevent the cover 50 from rotating and the locking pin 54 from disengaging slot 52. Cover 50 is also provided with a handle 59, whereas capsule 13 includes a fixed handle 60.

Figure 4:
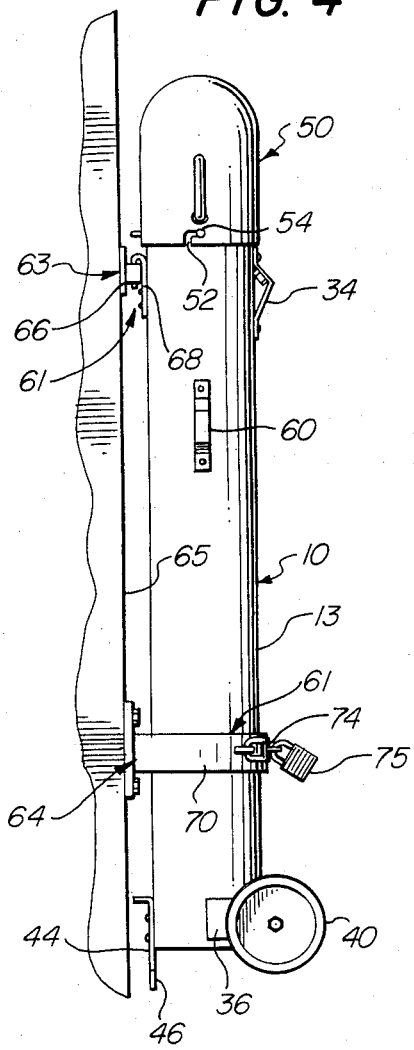
FIG. 4 is a side-elevational view of the present invention in a secured, stored and locking arrangement when mounted to a vehicle.
Figure 6:
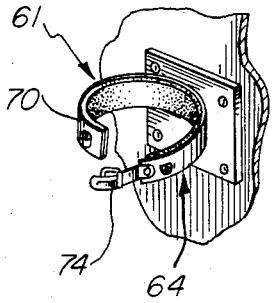
FIG. 6 is a perspective view of a locking clamp which is adapted to be mounted to a vehicle.

A unique advantage of the present invention is that there is provided a means 61 by which the golf cart/golf bag unit 10 is easily and securely mountable to a vehicle, as indicated generally at 63 in FIG. 7, for storage and transportation. It can also be readily seen that one or more units are capable of being attached to the outside structure 65 of a vehicle. Means 61 comprises a first and second structure bracket, respectively designated at 62 and 64. The first structure bracket includes a keeper member 66 that is fixedly secured to a structure 65, as illustrated in FIG. 4, and a clip member 68 which is affixed to housing 13 adjacent the upper end thereof. The second structure bracket 64 comprises a clamp strap 70 attached to a base plate 72 which in turn is mounted to structure 65. Clamp strap 70 is positioned so as to wrap around the annular wall which defines housing 13, and it includes a hold-down connection 74 which is adapted to be locked in position by a typical padlock 75. It should be understood that structure brackets 62 and 65 may be mounted to other structures as well as the one shown and described herein.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. In combination, a golf cart/golf bag assembly defining a transportation means comprising:

a rigid capsule defined by a tubular housing having a closed bottom end and a closed upper end;

said closed upper end being formed with an enlarged-diameter central opening and a plurality of reduced-diameter holes located about said central opening;

an elongated cup member disposed in said central opening wherein various types of golf equipment are stored;

a plurality of elongated tube members, each having an upper open end and a lower closed end, said tube members being fixedly mounted within said reduced-diameter holes so as to extend downwardly from said upper end within said capsule, whereby the shafts of golf clubs are received therein;

a cart handle removably mounted to said tubular housing of said capsule;

a pair of wheels mounted to said housing, whereby said capsule is moved along the ground surface;

means to position said capsule in a substantially upright mode;

wherein said positioning means comprises a spike member having a pointed end projecting below said bottom end of said housing, whereby said spike member engages said ground surface;

a removable rigid cover member formed to cover said upper end of said housing;

means for securing said cover to said housing;

means for securing said golf cart/golf bag assembly to a vehicle for transpoting said golf cart/golf bag assembly;

wherein said means for securing said golf cart/golf bag assembly to said vehicle comprises:

a first structure bracket positioned adjacent said upper end of said capsule; and a second structure bracket positioned adjacent said lower end of said capsule;

wherein said first structure bracket comprises:

a keeper member fixedly secured to the outer wall of said vehicle; and a clip member attached to said housing adjacent said upper end therof;

said second structure bracket comprising a clamp strap mounted to said vehicle whereby said clamp strap is mounted about said capsule adjacent said lower end thereof.

2. The combination as recited in claim 1, wherein said elongated tube members are formed having varied lengths to accommodate the respective lengths of said shafts of said golf clubs.

3. The combination as recited in claim 2, wherein said second structure bracket includes a base member, and wherein said clamp strap includes a hold-down connection whereby said clamp strap may be locked in a clamping position about said capsule.

4. A golf bag comprising:

an elongated, rigid, tubular capsule adapted to receive and store golf clubs and equipment wherein said capsule has an upper and lower closed end:

a plurality of elongated tubes positioned and supported in said upper closed end and extending downwardly in said capsule;

a storage cup member centrally mounted in said upper closed end and extending downwardly in said capsule;

a pair of wheels mounted adjacent said lower closed end of said capsule;

means for mounting said wheels to said capsule;

a rigid cover removably secured to said upper end of said capsule;

a handle means removably mounted to said capsule;

means for securing said capsule to the exterior of a vehicle for storage and transportation;

support means mounted at said lower end of said capsule whereby said capsule is held in an upright position;

wherein said means for securing said capsule to the exterior of a vehicle comprises:

a first structure bracket positioned adjacent said lower end of said capsule; and a second structure bracket positioned adjacent said lower end of said capsule;

wherein said first structure bracket includes:

a keeper member fixedly secured to said vehicle;; and a clip member mounted on said capsule whereby said clip member is interlocked with said keeper member;

and wherein said second structure bracket includes:

a clamp strap mounted to said vehicle whereby said capsule is clamped to said vehicle below said first structure bracket; and locking means attached to said clamp strap whereby said clamp strap is locked around said capsule.

5. A golf bag as recited in claim 4, wherein said wheel-mounting means comprises a rigid support strap having oppositely disposed ear members whereby said wheels are mounted to said ear members, and wherein said rigid support strap is affixed to said capsule to define an integral part thereof.

* * * * *